United States Patent [19]

Holt

[11] 4,452,833

[45] Jun. 5, 1984

[54] PAPER COATING METHOD

[75] Inventor: Sherwood G. Holt, Biron, Wis.

[73] Assignee: Consolidated Papers, Inc., Wisconsin Rapids, Wis.

[21] Appl. No.: 347,004

[22] Filed: Feb. 8, 1982

[51] Int. Cl.[3] ..... B05B 3/12; B05C 5/02

[52] U.S. Cl. ..... 427/356; 118/410

[58] Field of Search ..... 118/410, 411, 413, 126, 118/407; 427/356, 358, 355

[56] References Cited

U.S. PATENT DOCUMENTS

| | | | |
|---|---|---|---|
| 3,063,868 | 11/1962 | Brandsma et al. | 118/63 X |
| 3,418,970 | 12/1968 | Phelps et al. | 118/410 |
| 3,503,370 | 3/1970 | Ishiwata et al. | 118/50 |
| 3,518,964 | 7/1970 | Nagler | 118/410 X |
| 3,897,578 | 7/1975 | Kanda et al. | 118/410 X |
| 4,171,761 | 10/1979 | Boldt et al. | 118/410 X |
| 4,250,211 | 2/1981 | Damrau et al. | 118/413 X |

*Primary Examiner*—John P. McIntosh

*Attorney, Agent, or Firm*—Gary, Juettner & Pyle

[57] ABSTRACT

An improved method and apparatus for applying a film of coating material on a moving web of paper carried through an application zone, utilize a reservoir of liquid coating material established under pressure between liquid seals at forward and rearward ends of the zone, and a doctor blade loaded against the web rearwardly of the rearward liquid seal. The reservoir is formed by forward and rearward relatively movable, sealed members, the upper edges of which define gaps with the paper web and doctor blade, respectively, in which gaps the liquid seals are formed. Coating material is flowed under pressure and in excess into the application zone to enable a pressurized area of coating material to be developed therein against the web and immediately upstream of the doctor blade, with the excess of coating material overflowing from the zone through the gaps to form the liquid seals. The provision of two overflow routes for excess coating material aids in skipless application of coating on the web.

5 Claims, 1 Drawing Figure

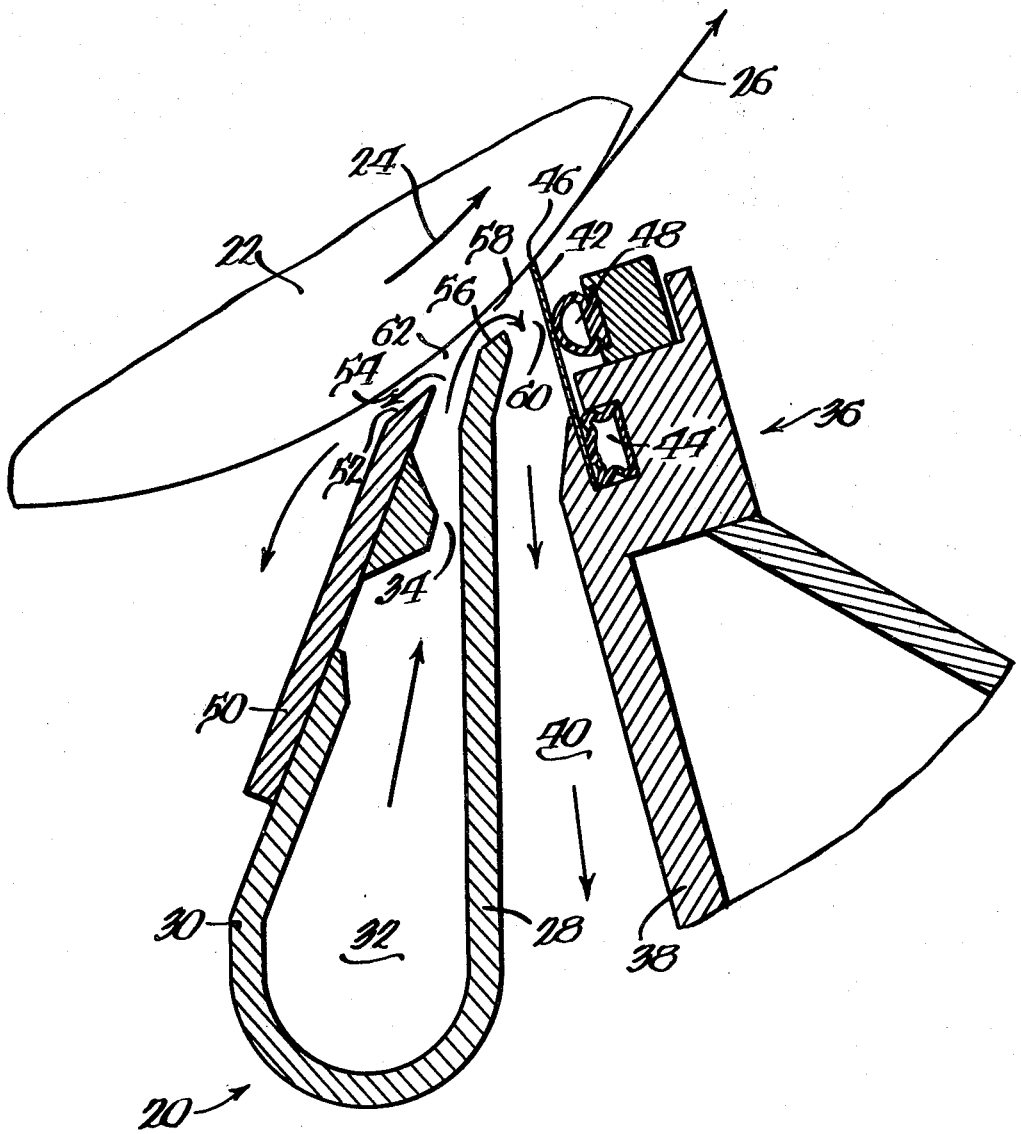
26
24
46
22
58
42
48
56
62
54
60
36
44
52
34
50
40
30
32
28
38
20

PAPER COATING METHOD

BACKGROUND OF THE INVENTION

The present invention relates to a method and apparatus for applying coating material on a moving web of paper, and in particular to a coating method and apparatus of the trailing blade type wherein light, medium or heavy weight coatings may be applied in a novel and improved manner.

Conventional coaters of the trailing blade type include means for applying coating material to a paper web that is usually supported and carried by a resilient backing roll, together with a flexible coater or doctor blade located on the trailing side of the applicator, which serves to doctor or level the applied coating. In general, an excess of coating material is applied on the web and the coater blade then meters or removes the excess while uniformly spreading the coating onto the web surface.

In recent years it has become desirable to produce papers having a minimum amount of coating. To achieve low coat weights with conventional trailing blade equipment it is necessary to increase the pressure of the coater blade against the web, which results in a high rate of wear of the blade and necessitates more frequent blade replacement. High blade pressure also increases the possibility of web breaks and streaking caused by foreign particles caught between the blade and web.

Conventional coaters employ a relatively long dwell or soak time, which is the time interval between initial application and final blading of the coating. As a result, the water portion of the coating composition, as well as the water soluble or dispersible materials contained therein, migrate into the moving web at a more rapid rate than the pigment and eventually cause an undesirable imbalance in the coating constituents and their rheological properties. Long soak periods are also incompatible with the application of successive web coats without intervening drying, because the successive coats tend to migrate into and contaminate the previous coat.

The foregoing problems are discussed in U.S. Pat. No. 3,348,526 issued to Neubauer, wherein a narrow stream of coating is extruded onto an inverted trailing blade that defines a nip region with a supported web. The coating application is such that the coating material is unpressurized after leaving an orifice and being supported on the blade, and the leading side of the coating material stream is exposed to the environs in the zone of application. Since the coating is bladed substantially immediately after application, soak times are kept to a minimum.

To overcome the disadvantages of the aforementioned applicators in applying lightweight coatings on paper, there has been developed a short dwell time applicator as disclosed in U.S. Pat. No. 4,250,211 issued to Damrau et al and assigned to the assignee of the present invention. In that applicator, coating material is introduced in excess into a relatively narrow application zone for being applied on a web carried therethrough. A forward wall of the applicator defines a relatively narrow gap with the web at the upstream end of the application zone, and excess material in the zone overflows through the gap and forms therein a liquid seal, so that coating material in the zone and as applied to the web is maintained under pressure. The speed of the web is adjusted for a relatively short dwell time, and a flexible coater blade doctors the web at the downstream end of the zone, thereby removing excess material from the web and at the same time uniformly spreading the material on the web. In consequence of the short dwell time of the pressurized application of coating material on the web, an appropriate yet lightweight amount of coating may be applied without need for high blade pressures.

A difficulty occasionally encountered in use of conventional applicators as well as the type disclosed in U.S. Pat. No. 4,250,211 is that, depending upon the nature of the paper and the coating material and the amount of material to be applied on the web, the coating may fail to properly cover the surface of the web. This results in "skipping" in the applied coating, which impairs its quality.

SUMMARY OF THE INVENTION

The short dwell time applicator or coater apparatus of the present invention constitutes an improvement over the aforesaid Damrau et al and Neubauer patents, in that an enclosed pressure reservoir or coating material application zone is established between the coating applicator, the blade and the supported web, with liquid seals being formed at forward and rearward ends of the zone.

The applicator may be used with a backing roll carrying a web of paper, or a pair of applicators may be arranged on opposite sides of the web so that a web supporting roll is not needed. The applicator includes a tapered chamber which receives therein a supply of coating material under pressure and directs the material through a narrow outlet orifice or slot into the application zone, and a doctor blade extends from the trailing side of the zone in contact with the web. The upper edges of front and rear walls of the chamber on opposite sides of the orifice are closely spaced from the supported web and doctor blade, respectively, so as to form, in conjunction with the pressurized liquid flowing from the orifice, respective forward and rearward liquid seals with the web and doctor blade. The sides of the orifice are sealed to the backing roll to allow establishment of positive liquid pressure in the zone of application, and the doctor blade levels the applied coating.

The coating applicator forms an enclosed pressure reservoir of coating material with the web to apply a continuous narrow strip or band of pressurized coating material on the web, which enables application of low coat weights. Excess coating material overflowing through the forward gap forms the leading liquid seal and seals the front end of the application zone to prevent entry of air and foreign matter therein, and excess coating material overflowing through the rearward gap forms the rearward liquid seal and seals the rearward end of the zone so that a pressurized area of coating material is developed immediately upstream of the doctor blade, with the two overflows together providing improved skipless coating performance.

The foregoing and other advantages and features of the method and apparatus of the invention will become apparent upon a consideration of the following detailed description, when taken in conjunction with the accompanying drawing.

BRIEF DESCRIPTION OF THE DRAWING

The single drawing FIGURE illustrates a short dwell time applicator for applying a coating to a moving web of paper, which is arranged in accordance with the teachings of the invention to generate upstream and downstream liquid seals for the application zone to enable a pressurized area of coating material to be developed in the zone and immediately upstream of a doctor blade.

DETAILED DESCRIPTION

The drawing illustrates an applicator or coater portion of a paper coating machine, which embodies the teachings of the present invention. The applicator includes a separate fountain, indicated generally at 20, extending parallel to and coextensively with a movable support or backing roll 22 which rotates in the direction shown by an arrow 24 and supports a web of paper 26 during its travel through an application zone. The fountain has rear and front walls 28 and 30 forming a chamber 32 therebetween for reception of liquid coating material under pressure from a source of material (not shown), and the walls converge upwardly toward one another and define a narrow outlet orifice or metering slot 34 which extends upwardly adjacent to, transversley across and facing the web support surface of the roll 22. Although not specifically shown, coating material is introduced into the chamber 32 through a manifold which provides a uniform introduction of coating material therein, and the front wall 30 is pivotally mounted relative to the rear wall 28 to permit the chamber 32 to be opened for cleaning and also to adjust the width of the metering slot 34.

The applicator also includes a main beam, indicated generally at 36, extending parallel to and coextensively with the backing roll 22. The beam has a front wall 38 which defines, along with the wall 28 of the fountain 20, a channel 40 for return to the supply of excess coating material overflowing from the application zone, as will be described. A flexible doctor or coater blade 42 at the downstream end of the application zone is held against a rearward surface of the wall 38 by a pneumatic tube 44 which is expandable by the introduction of fluid under pressure therein to press against the blade. The blade extends into engagement with the web 26 supported on the roll 22 and serves to meter and level the coating applied on the surface of the web. A tip 46 of the blade is urged or loaded against the roll supported web by a second pneumatic tube 48 and the amount, quantity or weight of coating applied to the web is influenced by the force of the blade tip against the web.

An orifice plate 50 is vertically adjustable on the front wall 30 of the fountain 20 and converges toward the roll supported web and the upper end of the rear wall 28. The plate has a free upper edge 52 which is juxtaposed to but spaced slightly from the web, such that a space or gap 54 between the edge and the web at a forward, leading or upstream end of the application zone is relatively small and less than one inch. Similarly, the rear wall 28 has an upper free edge 56 which is juxtaposed to but spaced slightly from the web and doctor blade, such that a space or gap 58 exists between the edge and the web, and a space or gap 60 between the edge and the doctor blade at a rearward, lagging or downstream end of the application zone is relatively small and less than one inch. As will be described, excess coating material introduced into the application zone from the chamber 32 and through the orifice 34 overflows from the zone through the gaps and forms a liquid seal in the gap 54 at the forward end of the zone and a liquid seal in the gap 60 at the rearward end of the zone, thereby enabling pressurized application of coating material onto the web in the zone.

At the two side ends of the coater, the spaces between the coater blade 42 and the orifice plate 50 are sealed off in a manner known in the art by flexible edge dams (not shown), which seal with the walls 28 and 38, the orifice plate 50, the doctor blade 42 and the roll supported web 26, thereby to define a generally closed coating material application zone 62 downstream from the metering slot 34 and between the web 22, the doctor blade 42 and the gaps 54 and 60.

Except for the gaps 58 and 60, the coating applicator as described is generally of the type disclosed in detail in aforementioned U.S. Pat. No. 4,250,211, assigned to the assignee of the present invention, and the teachings of which are specifically incorporated herein by reference. For a more specific description of the applicator, reference is made to that patent.

In operation of the applicator, and to the extent taught by U.S. Pat. No. 4,250,211, coating liquid is introduced under sufficient pressure and in sufficient quantity to completely fill the chamber 32, the metering slot 34 and the application zone 62 defined by the doctor blade 42, the orifice plate 50 and the end dams, to cause a continuous, copious flow of coating material reversely of the direction of web travel through the narrow space or gap 54 defined between the upper edge 52 of the orifice plate and the web. This forms a liquid seal between the edge and the web and causes the coating liquid to be applied to the web in a very narrow transverse band under a constant positive pressure. The copious excess of coating liquid that flows through the gap 54 reversely of the direction of web travel forms a non-abrasive liquid seal with the web at the upstream or forward end of the coating application zone; causes the coating liquid in the application zone to be maintained under pressure and to be applied to the web under pressure; seals off the forward edge of the application zone against entry of air and foreign matter; strips air from the high speed web and prevents such air from causing streaks or skips in the coating on the web; and causes the coater blade 42 to doctor the coating liquid while the liquid is held under pressure.

In improving on the applicators taught in U.S. Pat. No. 4,250,211, however, in accordance with the teachings of the invention a liquid seal is also formed in the gap 60 at the downstream or rearward end of the application zone. To this end, the quantity and pressure of coating material introduced into the chamber 32 is not only sufficient to completely fill the application zone 62 and to form a liquid seal in the leading gap 54, but is also sufficient to cause a flow of material over the upper edge 56 of the wall or weir 28 which forms a liquid seal in the gap 60. Coating material flowing through the gap 54, along with material flowing through the gap 60 and the channel 40, is then collected for return to the main supply and recirculation.

As previously described, the orifice plate 50 is vertically movable along the front wall 30 of the fountain 20 to control the size of the gap 54. To control the size of the gap 60, the fountain is adjustably movable in a tangential direction about the backing roll 22 toward and away from the metering blade 42. Consequently, by controlling the sizes of the gaps 54 and 60 and the quantity of coating liquid introduced into the chamber 32, the volume flow of coating liquid through the two return routes, i.e., the gaps 54 and 60, may be controlled to generate a pressurized area of coating liquid, or a pressurized coating liquid application zone, extending from the gap 54 to immediately upstream of the metering blade. By virtue of providing two overflow or return routes for excess coating material, or liquid seals at the leading and lagging ends of the application zone, very uniform and skipless coatings may advantageously be applied on the web.

The applicator is generally referred to as a short dwell time applicator. That is, to avoid saturation of the web with coating material, thereby to prevent the water portion of the coating composition as well as the water soluble or dispersible materials contained therein from migrating into the web at a more rapid rate than the pigment, the web is exposed to the coating material in the application zone 62 for only a relatively short time. To this end, the width of the zone in the direction of web travel, as well as the speed of travel of the web through the zone, are controlled to provide a relatively short dwell time of the web within the zone. With prior applicators having a short dwell time, a difficulty occasionally encountered is that the coating may fail to fully penetrate and cover the surface of the web. However, by virtue of the two overflow routes and liquid seals at the forward and rearward ends of the application zone, the web is twice exposed to a relatively rapid flow of coating material across its surface which fully and completely coats the surface, whereby the quality of coating applied on the web is improved.

While one embodiment of the invention has been described in detail, various modifications and other embodiments thereof may be devised by one skilled in the art without departing from the spirit and scope of the invention, as defined in the appended claims.

What is claimed is:

1. A method of applying coating liquid to a moving web of paper, comprising the steps of:

applying coating liquid to one surface of a moving web of paper carried through an application zone having spaced front and rear edges, a wall intermediate the edges and spaced from the web and from the front and rear edges, and laterally spaced side edges, the application zone being defined between the front and rear edges;

forming and maintaining a reservoir of coating liquid under pressure on the web throughout the application zone;

doctoring the coating liquid on the web at the rear edge of the application zone;

maintaining the coating liquid throughout the application zone under pressure by substantially sealing the side edges of the zone and by establishing a first liquid seal in a first gap defined between the web and the front edge of the application zone which extends substantially across the width of the web and by establishing a second liquid seal in a second gap defined between the wall and the rear edge of the application zone, whereat the web is doctored, which extends substantially across the width of the web; and continuously flowing coating liquid under pressure into the application zone to substantially completely and continuously fill the first and second gaps with coating liquid for forming the first and second liquid seals, for sealing off the front and rear edges of the zone and preventing entry of air and foreign matter through the gaps thereat and into the zone, and for maintaining a pressurized area of coating liquid throughout the zone between the front and rear edges and for continuously purging the zone.

2. A method as in claim 1, including the step of causing the coating liquid delivered under pressure to the application zone to flow under pressure through the first gap reversely of the direction of web travel and under pressure through the space between the wall and the web and to and through the second gap in the direction of web travel.

3. A method as in claim 1, wherein the continuously flowing step includes the step of introducing coating liquid into the application zone between the front edge of the zone and the wall for flowing both through the first gap and across the wall and through the second gap to establish the first and second liquid seals.

4. A method as in claim 1, including the steps of independently moving the front edge of the application zone toward and away from the web to adjust the size of the first gap between the web and the front edge for maintaining the first liquid seal, and moving the wall toward and away from the rear edge of the application zone to adjust the size of the second gap for maintaining the second liquid seal, whereby the coating liquid is maintained under pressure in the application zone.

5. A method as in claim 1, wherein the doctoring step includes doctoring the coating liquid on the web within about 0.01 second of its application to the web.

* * * * *